United States Patent [19]

Gorecki

[11] 4,339,707

[45] Jul. 13, 1982

[54] BAND GAP VOLTAGE REGULATOR

[75] Inventor: James L. Gorecki, Plymouth, Minn.

[73] Assignee: Honeywell Inc., Minneapolis, Minn.

[21] Appl. No.: 219,792

[22] Filed: Dec. 24, 1980

[51] Int. Cl.[3] ..... G05F 3/20

[52] U.S. Cl. ..... 323/313; 323/281; 323/901; 307/297

[58] Field of Search ..... 323/281, 313, 314, 901, 323/907; 307/296 R, 297, 298, 299 B; 357/28, 51

[56] References Cited

U.S. PATENT DOCUMENTS

| | | | |
|---|---|---|---|
| 2,954,486 | 9/1960 | Doucette et al. | 307/299 R |
| 3,510,735 | 5/1970 | Potter | 357/51 |
| 3,629,692 | 12/1971 | Goyer | 323/315 |
| 3,659,121 | 4/1972 | Frederiksen | 307/297 |
| 3,721,893 | 3/1973 | Davis | 323/317 |
| 3,936,813 | 2/1976 | Tsang | 365/154 |
| 4,057,894 | 11/1977 | Khajezadeh et al. | 29/577 C |
| 4,100,565 | 7/1978 | Khajezadeh et al. | 357/51 |
| 4,123,698 | 10/1978 | Timko et al. | 323/316 |

OTHER PUBLICATIONS

*Integrated Circuit Engineering* by Glasser, Subak and Sharpe published by the Addison-Wesley Publishing Co. (1977), pp. 513-517.

*Primary Examiner*—William M. Shoop
*Assistant Examiner*—Peter S. Wong
*Attorney, Agent, or Firm*—Theodore F. Neils; David F. Fairbairn

[57] ABSTRACT

An improved band gap voltage regulator provides a stable, temperature-independent, output voltage which is approximately equal to the band gap voltage of silicon or a function thereof. The circuit utilizes integrated circuit resistors and bipolar transistors. Semiconductor process variations which affect transistor base-emitter junction voltage and thus would otherwise affect the value of the output voltage are compensated by a base pinch resistor.

29 Claims, 3 Drawing Figures

BAND GAP VOLTAGE REGULATOR

BACKGROUND OF THE INVENTION

1. Field of the Invention

The present invention relates to monolithic integrated circuit band gap voltage regulators.

2. Description of the Prior Art

There are many electrical circuit applications in which a stable, constant voltage reference is required. In particular, voltage reference circuits which are capable of fabrication as integrated circuits are particularly advantageous. Examples of prior art voltage reference circuits are shown in U.S. Pat. No. 3,648,153 by Graf; U.S. Pat. No. 4,064,448 by Eatock; and U.S. Pat. No. 4,088,941 by Weatly, Jr.

One type of constant voltage reference circuit which is particularly useful in monolithic integrated circuits is called a band gap voltage regulator, which provides a regulator output voltage which is stable, essentially temperature independent, and approximately equal to the band gap voltage of silicon. One band gap voltage regulator of this type, and other pertinent semiconductor information, is described in the book *Integrated Circuit Engineering* by Glaser, Subak and Sharpe and published by the Addison-Wesley Publishing Company (1977). The band gap voltage reference described by Glaser, Subak and Sharpe at pages 513–517 uses a pair of identical transistors and a pair of resistors to form a logarithmic current source. A third transistor and resistor are connected to the logarithmic current source to provide an output voltage which is a function of the base emitter voltage ($V_{BE}$) of the third transistor and the current flow through the third resistor. By proper selection of the values of the three resistors, the output voltage is temperature compensated and is essentially equal to the band gap voltage. The output voltage of the band gap regulator and the conditions for temperature independence both depend upon the value of $V_{BE}$ of the third transistor.

Prior to the filing of the present patent application, a search of prior art was performed, and the following patents were identified:

| | |
|---|---|
| Doucette et al. | U.S. Pat. No. 2,954,486 |
| Potter | 3,510,735 |
| Goyer | 3,629,692 |
| Frederiksen | 3,659,121 |
| Davis | 3,721,893 |
| Tsang | 3,936,813 |
| Khajezadeh et al. | 4,057,894 |
| Khajezadeh et al. | 4,100,565 |
| Timko et al. | 4,123,698 |

The Doucette et al. U.S. Pat. No. 2,954,486 describes a semiconductor resistance element termed a "field effect varistor."

The Potter U.S. Pat. No. 3,510,735 describes an integrated circuit junction transistor with an integral base pinch resistor.

The Goyer U.S. Pat. No. 3,629,692 shows electrical circuits which provide a relatively constant predetermined current from a source of potential which may vary over a wide range of values. The circuit utilizes bipolar transistors and resistors.

The Frederiksen U.S. Pat. No. 3,659,121 shows a constant current source utilizing transistors and resistors. The Frederiksen patent states in its "Background" that attempts had been made to use a pinch resistor as the high emitter resistor in prior art constant current sources.

The David U.S. Pat. No. 3,721,893 describes a current reference circuit in which variations in the beta of the transistors of the circuit are compensated for by additional beta dependent components.

The Tsang U.S. Pat. No. 3,936,813 shows a bipolar random access memory (RAM) cell which utilizes transistors cross-coupled to form flip-flops. The flip-flop load resistors are base pinch resistors which compensate for variations in the gain (beta) of the flip-flop transistors due to normal fabrication process variations. As a result, the memory cells exhibit substantially constant read/write characteristics despite process variations.

In the Khajezadeh et al. U.S. Pat. Nos. 4,057,894 and 4,100,565, an integrated circuit includes a compensation resistor whose width varies in the same manner as the width of the base of the lateral transistor. Since the base width of the transistor has a value proportional to the beta of the transistor, the compensation resistor is connected in a circuit with the transistor to compensate for variations in the base width of the transistor.

The Timko et al. U.S. Pat. No. 4,123,698 shows an integrated circuit temperature transistor which provides a current output which is linearly related to absolute temperature. The output current is developed by resistive means based upon the difference in base-emitter voltages of a pair of transistors having conductive areas of different sizes.

SUMMARY OF THE INVENTION

The present invention is an improved monolithic integrated circuit reference voltage source of the type having first and second transistors and first and second resistors which form a logarithmic current source in which the current density in the emitter of the second transistor is less than the current density in the emitter of the first transistor. Third resistor means and third transistor means are connected to the second transistor to provide an output voltage.

The present invention is based upon the recognition that normal variations in semiconductor processing result in variations in the saturation current ($I_S$) of a bipolar transistor, and that the base emitter junction voltage, $V_{BE}$, of a bipolar transistor is a function of $I_S$. Thus the band gap regulator output voltage and its temperature dependence could be affected by normal integrated circuit semiconductor process variations.

In the voltage regulator circuit of the present invention, variations of $V_{BE}$ of the third transistor means resulting from integrated circuit semiconductor process variations are compensated by third resistor means, which includes a base pinch resistor. The resistance of the base pinch resistor is a function of saturation current $I_S$, and thus is affected by the same process variations which affect the emitter voltage $V_{BE}$ of the third transistor means. By including a base pinch resistor as part of the third resistor means, variations in $V_{BE}$ as a function of $I_S$ are compensated such that the output voltage of the voltage regulator does not change as a function of the process variations which affect saturation current $I_S$.

In preferred embodiments, the present invention also includes an additional base diffusion resistor in parallel with the base pinch resistor as part of the third resistor means. The additional resistor is used to meet certain conditions in the circuit necessary for satisfactory compensation.

DETAILED DESCRIPTION OF THE PREFERRED EMBODIMENT

Figure 1:
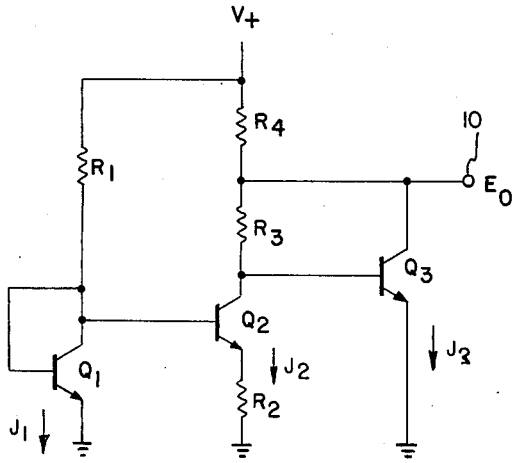
Fig. 1 Prior Art
FIG. 1 is an electrical schematic diagram of a prior art band gap voltage regulator.

The Prior Art Band Gap Voltage Regulator—FIG. 1

FIG. 1 shows schematic diagram for a prior art monolithic integrated circuit band gap voltage regulator which is described in the previously mentioned text by Glaser, Subak and Sharpe. The voltage regulator includes three identical NPN transistors $Q_1$, $Q_2$ and $Q_3$ having identical base-emitter areas, and four resistors $R_1$, $R_2$, $R_3$, and $R_4$ which are typically formed in a monolithic integrated circuit by diffusion techniques.

Transistor $Q_1$ has its base and collector connected through resistor $R_1$ to a positive voltage supply terminal V+, and has its emitter connected to ground. Transistor $Q_2$ has its base connected to the base of $Q_1$ and its emitter connected through resistor $R_2$ to ground. Transistors $Q_1$ and $Q_2$ and resistors $R_1$ and $R_2$ form a logarithmic current source in which the current density $J_2$ in the emitter of transistor $Q_2$ is less than the current density $J_1$ in the emitter of transistor $Q_1$ due to the voltage developed across resistor $R_2$.

Resistor $R_3$ is connected between output terminal 10 and the collector of transistor $Q_2$. Transistor $Q_3$ has its base collected to the collector of $Q_2$, its collector connected to the output terminal 10, and its emitter connected to ground. Resistor $R_4$ is connected between the positive supply voltage terminal V+ and output terminal 10.

The output voltage $E_O$ appearing at output terminal 10 is a function of the voltage developed across resistor $R_3$ and the base-emitter voltage $V_{BE3}$ of transistor $Q_3$. In other words:

$$E_O = V_{BE3} + I_{C2}R_3 = V_{BE3} + \frac{R_3}{R_2}(V_{BE1} - V_{BE2}) \quad \text{Equation 1}$$

Assuming equal base-emitter areas of transistors $Q_1$ and $Q_2$:

$$V_{BE1} - V_{BE2} = \frac{kT}{q}\ln\left(\frac{J_1}{J_2}\right) = V_T \ln\left(\frac{J_1}{J_2}\right) \quad \text{Equation 2}$$

Where k is the Boltzmann constant, q is the electronic charge, J is current density and T is the absolute operating temperature.

As demonstrated by Glaser, Subak and Sharpe, the output voltage $E_O$ of the circuit of FIG. 1 is:

$$E_O \cong V_{gO}\left(1 - \frac{T}{T_O}\right) + V_{BEO3}\left(\frac{T}{T_O}\right) + \frac{R_3}{R_2} V_T \ln\left(\frac{J_1}{J_2}\right) \quad \text{Equation 3}$$

Where $V_{gO}$ is the band gap voltage extrapolated to absolute zero, T is again the absolute operating temperature, $T_O$ is an initial absolute operating temperature, and $V_{BEO3}$ is the base-emitter voltage of transistor $Q_3$ at temperature $T_O$.

Glaser, Subak and Sharpe also indicate that for zero temperature drift of the output voltage $E_O$ $$\left(\text{i.e. } \frac{\partial E_O}{\partial T} = 0\right)$$

the following relationship must be met:

$$V_{BEO3} + \left(\frac{T_O}{T}\right)\left(\frac{R_3}{R_2}\right) V_T \ln\left(\frac{J_1}{J_2}\right) = V_{gO} \quad \text{Equation 4}$$

By substituting Equation 4 into Equation 3, it can be seen that the output voltage is equal to the band gap voltage, i.e. $E_O = V_{gO}$, and that the regulated output voltage is then temperature independent. In practice $E_O$ is set just a bit higher than $V_{gO}$ to achieve temperature independence because of some approximations in the analysis.

As shown by Equations 3 and 4, both the output voltage $E_O$ and the conditions for temperature independence depend upon the value of $V_{BEO3}$. Unfortunately, the process variations normally encountered in integrated circuit fabrication processes affect the value of the $V_{BEO3}$. These process variations, therefore, directly affect the band gap regulator output voltage $E_O$ and its temperature dependence.

In the prior art circuit described by Glaser, Subak and Sharpe, the ratio of resistors $R_3/R_2$ typically remains substantially constant because of substantially equal resistance temperature coefficients, and the ratio of current densities $J_1/J_2$ remains substantially constant because of uniform semiconductor layout geometry. As a result, the output voltage $E_O$ and its temperature dependence are practically totally dependent upon the value of $V_{BEO3}$.

In some circuit applications, the output voltage of the band gap voltage regulator is required to be held within voltage limit tolerances which are less than the typical voltage tolerances of $V_{BEO3}$ produced by normal integrated circuit processing. One method of achieving these required voltage limit tolerances is to sort by testing individual band gap regulator circuits and rejecting those which do not meet the required voltage tolerances. This results, however, in lower yields, which in turn results in increases user cost. It is desirable, therefore, to provide a band gap voltage regulator which is compensated for variations in $V_{BEO3}$ introduced by the normal integrated circuit fabrication processes.

THE IMPROVED BAND GAP VOLTAGE REGULATOR OF FIG. 2

Figure 2:
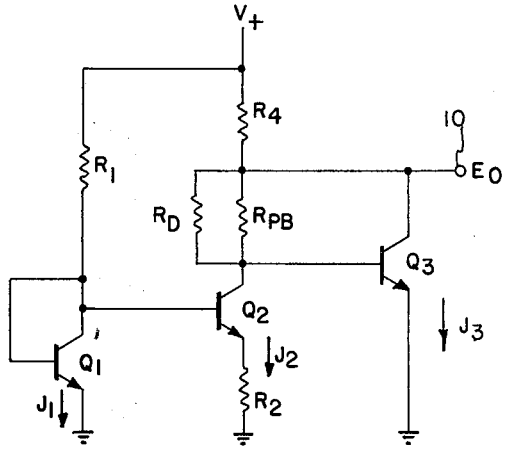
FIG. 2 is an electrical schematic diagram of a band gap voltage regulator utilizing the present invention to compensate for variation in base-emitter voltage of the bipolar transistors.

FIG. 2 shows an embodiment of the present invention which overcomes the shortcomings of the prior art band gap voltage regulator of FIG. 1. The monolithic integrated circuit of FIG. 2 is generally similar in construction to that of FIG. 1, and similar elements have been labeled with similar reference characters and numerals.

In the band gap voltage regulator of FIG. 2, resistor $R_3$ has been replaced by a base pinch resistor $R_{PB}$ (formed by an emitter diffusion across a base diffusion resistor) and a base diffusion resistor $R_D$ which are connected in parallel between output terminal 10 and the collector of transistor $Q_2$. Base pinch resistor $R_{PB}$ compensates for variations in $V_{BEO3}$ since $R_{PB}$ is formed at the same time and by the same process as the base-emitter junction of transistor $Q_3$. The base diffusion in fabricating monolithic integrated circuits is that diffusion in which the base region of the bipolar transistors being made are formed, and the emitter diffusion is that diffusion in which the transistor emitters are formed. Resistors $R_1$, $R_2$ and $R_4$ will typically also be formed along with resistor $R_D$ as base diffusion regions, but they need not be as any or all of these resistors could be formed as thin film resistors or other monolithic integrated circuit resistor structures. Just base pinch resistor $R_{PB}$ is needed to be formed as a pn semiconductor junction isolated semiconductor material resistor.

The value of $V_{BEO3}$ is a function of the saturation current of transistor $Q_3$, as illustrated by the following relationship:

$$V_{BEO3} = \frac{kT_O}{q} \ln\left(\frac{J_3}{I_{SO3}}\right) = V_{TO} \ln\left(\frac{J_3}{I_{SO3}}\right) \quad \text{Equation 5}$$

The value of saturation current $I_{SO3}$ may be expressed as follows:

$$I_{SO3} = \frac{qAn_i^2}{Q_B} \cdot D_n \quad \text{Equation 6}$$

where $Q_B$=total base doping

A=base-emitter junction area $n_i$=intrinsic carrier concentration $D_n$=average effective value of the diffusion constant, and q=charge on an electron.

Since the value of $I_{SO3}$ is dependent upon parameters affected by semiconductor processing, $V_{BEO3}$ is affected by semiconductor processing variations.

In the present invention, the process-related variations in $V_{BEO3}$ are compensated for by base pinch resistor $R_{PB}$, which has a resistance which varies as a function of semiconductor pn junction saturation current. The relationship between saturation current $I_S$ and base pinch resistance is described in "Experimental Study of Gummel-Poon Model Parameter Correlations for Bipolar Junction Transistors," Divekar, Dutton and McCalla, *IEEE Journal of Solid State Circuits*, SC-12, 552–559 (October 1977). Based upon data for a particular bipolar semiconductor process, the authors developed a linear regression equation for base pinch resistance with saturation current as an independent variable which accounts statistically for ninety percent (90%) of the variation in this resistance.

The relationship found between base pinch resistance and saturation current with the following general form:

$$R_{PB}=K \cdot I_S+Y=K \cdot CI_{SO3}+Y \text{ (Kilo-ohms)}$$

Equation 7 where K and Y are constants, and $I_S$ is normalized to $10^{-16}$ amperes. The values of constants K and Y vary from process to process which are typically determined by statistical analysis of devices fabricated by the particular process. Since the junctions around $R_{PB}$ are fabricated concurrently with those in $Q_3$ and so are quite similar except possibly with respect to the areas thereof, the saturation current $I_S$ associated with $R_{PB}$ is proportional to the saturation current $I_{SO3}$ associated with $Q_3$. The constant of proportionality, 6, can be made equal to one by proper configurational choices for $R_{PB}$ and $Q_3$, and will be assumed to so equal hereinafter.

In the present invention, the values of $R_D$ and $R_{PB}$ are selected so that as $V_{BEO3}$ decreases, the effective resistance $R_3'$ of the parallel combination of $R_{PB}$ and $R_D$ increases with the effect of restoring $E_O$ to its nominal value. Conversely, as $V_{BEO3}$ increases, $R_{PB}$ decreases and resistance $R_3'$ decreases thus restoring $E_O$. The selection of the values of $R_{PB}$ and $R_D$ is based upon an attempt to minimize the effect of saturation current $I_{SO3}$ upon the output voltage $E_O$, as expressed in Equation 3. By substituting Equation 5 into Equation 3 and replacing resistance value $R_3$ with resistance value $R_3'$, the following relationship is obtained:

$$E_O \cong V_{gO}\left(1-\frac{T}{T_O}\right)+\left(\frac{T}{T_O}\right) V_{TO} \ln\left(\frac{J_3}{I_{SO3}}\right)+\frac{R_{3'}}{R_2} V_T \ln\left(\frac{J_1}{J_2}\right) \quad \text{Equation 8}$$

By differentiating Equation 8 with respect to saturation current $I_{SO3}$ and setting the result to zero after appropriate substitutions for $V_T$ and $V_{TO}$, the following result is obtained:

$$\frac{\partial R_{3'}}{\partial I_{SO3}} = \frac{R_2}{\ln (J_1/J_2)} \cdot \frac{1}{I_{SO3}} \quad \text{Equation 9}$$

Thus, if the condition of Equation 9 is met, the output voltage of the band gap regulator of FIG. 2 can substantially avoid variation in $E_O$ for small process variations in saturation current $I_{SO3}$. Of course, to substantially avoid variation in $E_O$ due to temperature, the condition of Equation 4 must also be met substituting $R_3'$ for $R_3$.

In the preferred embodiments of the present invention shown in FIG. 2, resistance $R_3'$ is formed by the parallel combination of base pinch resistor $R_{PB}$ and base diffusion resistor $R_D$. The value of the parallel combination of these two resistors is:

$$R_{3'} = \frac{R_{PB} \cdot R_D}{R_{PB}+R_D} \quad \text{Equation 10}$$

The base diffusion resistor $R_D$ has very little sensitivity to the saturation current $I_S$. The dependence of $R_{PB}$ on $I_S$ has been described by Equation 7. The use of the parallel combination of $R_D$ and $R_{PB}$ allows the total dependence of $R_3'$ to be adjusted during design to meet the requirements for zero temperature dependence i.e. $\partial E_O/\partial T=0$.

By substituting Equation 7 into Equation 10 and differentiating the resulting equation, the following relationship is obtained for C=1:

$$\frac{R_{3'}}{I_{SO3}} = \frac{R_{3'}}{I_S} = \frac{K \cdot R_D^2}{(K \cdot I_S + Y + R_D)^2} \quad \text{Equation 11}$$

Thus, by having the right-hand side of Equation 11 equal the right-hand side of Equation 9, substantial variation in $E_O$ due to processing variation in $I_{SO3}$ can be avoided. This can be achieved while still meeting the condition Equation 4 to avoid substantial temperature variation in $E_O$ because the introduction of both the base pinch resistor $R_{PB}$ and the base diffusion resistor $R_D$ in the circuit gives sufficient design freedom as can be seen from Equation 4 and from the equation resulting from equating the right-hand sides of Equations 9 and 11.

THE BAND GAP VOLTAGE REGULATOR OF FIG. 3

Figure 3:
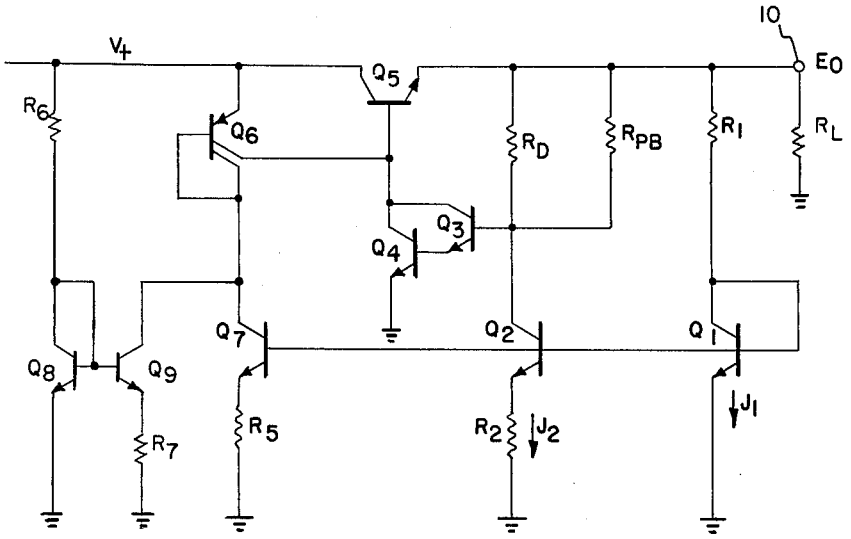
FIG. 3 is an electrical schematic diagram of another embodiment of the band gap voltage regulator of the present invention.

FIG. 3 shows another monolithic integrated circuit embodiment of the present invention which provides an improvement (at an operating temperature of 22° C.) of approximately nine times in the control of the absolute output voltage $E_O$ in comparison to the uncompensated prior art circuit of FIG. 1. Circuit components of similar function in both the circuits of FIGS. 2 and 3 again have common designation in each of these figures.

In the embodiment shown in FIG. 3, transistors $Q_1$ and $Q_2$ and resistors $R_1$ and $R_2$ again form a logarithmic current source. Resistor $R_1$ is connected between output terminal 10 and the collector of transistor $Q_1$. The emitter of $Q_1$ is connected to ground, and the base of $Q_1$ is connected to the collector of $Q_1$ and to the base of transistor $Q_2$. Resistor $R_2$ is connected between the emitter of $Q_2$ and ground.

Base diffusion resistor $R_D$ and base pinch resistor $R_{PB}$ are connected in parallel between output terminal 10 and the collector of $Q_2$, and again provide compensation for variations in saturation current caused by normal integrated circuit process variations.

In FIG. 3, transistor $Q_3$ and transistor $Q_4$ are connected in a Darlington configuration. The base of $Q_3$ is connected to the collector of $Q_2$, the collectors of $Q_3$ and $Q_4$ are connected together, the emitter of $Q_3$ is connected to the base of $Q_4$, and the emitter of $Q_4$ is connected to ground. The use of a Darlington configuration rather than a single transistor (as in FIG. 2) provides higher effective current gain and thus minimizes the amount of base current supplied to $Q_3$. This is particularly advantageous because the base current to $Q_3$ represents an error between the current flowing through resistors $R_D$ and $R_{PB}$ and the current flowing through $Q_2$.

The Darlington transistor formed by transistors $Q_3$ and $Q_4$ controls a regulator circuit formed by NPN transistor $Q_5$, PNP transistor $Q_6$, NPN transistor $Q_7$, and resistor $R_5$. Transistor $Q_5$ has its collector connected to the V+ supply terminal, its emitter connected to output terminal 10, and its base connected to the collectors of transistors $Q_3$ and $Q_4$. Transistor $Q_6$ is a multiple collector transistor having its emitter connected to the +V supply terminal, one collector to the base of $Q_5$ and the collectors of $Q_3$ and $Q_4$, and its base and its other collector connected to the collector of transistor $Q_7$. The base of $Q_7$ is connected to the bases of transistors $Q_1$ and $Q_2$. Resistor $R_5$ is connected between the emitter of $Q_7$ and ground.

Transistor $Q_7$ controls the current flow through transistor $Q_6$, and thus the collector current from $Q_6$ which is provided to the base of $Q_5$ and the collectors of $Q_3$ and $Q_4$. Transistors $Q_3$ and $Q_4$ regulate the amount of base current supplied to $Q_5$, and thus the voltage at output terminal 10, is a feedback loop to maintain the output voltage $E_O$ at a value equal to the voltage drop across resistors $R_{PB}$ and $R_D$ due to the current flow through resistors $R_D$ and $R_{PB}$ set by the logarithmic current source based on $Q_3$ and $Q_4$, plus the base-emitter voltages of $Q_3$ and $Q_4$. This feedback loop will maintain the output voltage $E_O$ at a predetermined design value even in the event of a change in the effective load resistance $R_L$ of the load attached to output terminal 10.

The band gap voltage regulator of FIG. 3 also includes a starter circuit formed by resistors $R_6$ and $R_7$ and NPN transistors $Q_8$ and $Q_9$. Resistor $R_6$ is a very large (~15 Kohms) resistor which is connected between the V+ terminal and the collector of $Q_8$. The emitter of $Q_8$ is connected to ground, and the base of $Q_8$ is connected to the base of transistor $Q_9$ and to the collector of $Q_8$. Transistor $Q_9$ has its collector connected to the collector of transistor $Q_7$ and its emitter connected through resistor $R_7$ to ground.

When the supply voltage V+ is first applied to the circuit of FIG. 3, transistors $Q_1$, $Q_2$, $Q_3$, $Q_4$ and $Q_7$ are all turned off. The starter circuit provides a very small current (preferably on the order of about 1 microampere) to turn on the transistors and start operation of the band gap voltage regulator. As voltage V+ is first applied to the circuit, transistors $Q_8$ and $Q_9$ turn on, thus drawing current through transistor $Q_6$. Current is also supplied by $Q_6$ to the base of transistor $Q_5$, which begins to turn on. Output voltage $E_O$ begins to rise, and transistors $Q_1$, $Q_2$, $Q_3$, $Q_4$ and $Q_7$ receive current to begin operation. Voltage $E_O$ continues to rise until it hits its predetermined design value, at which point it stabilizes. As indicated in the discussion of the feedback loop above, this value equals:

$$E_O = V_{BE3} + V_{BE4} + \frac{R_{3'}}{R_2}(V_{BE1} - V_{BE2}) \quad \text{Equation 12}$$

Again, two conditions can be found for the circuit parameters of the FIG. 3 circuit to meet to substantially avoid temperature dependence and saturation current dependence in this output voltage $E_O$. If such conditions are met, $E_O$ will be a function of primarily the band gap voltage of silicon.

In a preferred embodiment of the present invention, all of the emitter areas of transistor $Q_1$–$Q_7$ are equal. The nominal value of saturation current $I_S$ for both transistor $Q_3$ and base pinch resistor $R_{PB}$ is $0.34 \times 10^{-16}$ amperes. The values of $R_{PB}$, $R_D$, $R_1$ and $R_2$ are selected to that the output voltage $E_O$ is 3.2 volts. Base pinch resistor $R_{PB}$ has a nominal resistance of 210 Kohms and resistor $R_D$ has a nominal resistance of 12.8 Kohms. The nominal resistance of resistor $R_1$ is 3.2 Kohms; the nominal resistance of resistor $R_2$ is 257 ohms; and the nominal resistance of resistor $R_5$ is 205 ohms. $R_7$ has a nominal resistance of 1000 ohms. Again, resistors $R_1$, $R_2$, $R_D$, $R_5$, $R_6$ and $R_7$ will typically be formed as pn junction isolated semiconductor material resistors from base diffusion regions but could be thin film resistors or by other well known monolithic integrated circuit resistor structures. Resistor $R_{PB}$ is again formed in the manner indicated for the corresponding resistor in FIG. 2.

CONCLUSION

The band gap voltage regulator of the present invention, which utilizes a base pinch resistor to compensate for process variations in base-emitter voltage, provides improved control of the output voltage $E_O$. This improved band gap voltage regulator is capable of fabrication in a monolithic integrated circuit using only transistors and resistors formed by conventional monolithic integrated circuit fabrication techniques.

Although the present invention has been described with reference to preferred embodiments, workers skilled in the art will recognize that changes may be made in form and detail without departing from the spirit and scope of the invention.

The embodiments of the invention in which an exclusive property or right is claimed are defined as follows:

1. An integrated circuit reference voltage source for providing a reference voltage at an output terminal means, the reference voltage source comprising:

first transistor means having a base, a collector, and an emitter, the base and collector being connected together;

first resistor means connected to the collector of the first transistor means;

second transistor means having a base, a collector, and an emitter, the base of the second transistor means being connected to the base of the first transistor means;

second resistor means connected to the emitter of the second transistor means;

a voltage supply terminal means for connection to a supply voltage;

coupling means connected between the voltage supply terminal and the output terminal means;

base pinch resistor means connected between the output terminal means and the collector of the second transistor means; and output control transistor means having a base, a collector, and an emitter, the base of the output control transistor means being connected to the collector of the second transistor means and the collector of the output control transistor means being connected to the coupling means to control the reference voltage at the output terminal means as a function of a base-emitter voltage of the output control transistor means and a voltage developed across the base pinch resistor means.

2. The reference voltage source of claim 1 and further comprising:

parallel resistor means connected in parallel with the base pinch resistor means.

3. The reference voltage source of claim 2 wherein the base pinch resistor means has a resistance which is at least one order of magnitude larger than a resistance of the parallel resistor means.

4. The reference voltage source of claim 2 wherein the parallel resistor means is a base diffusion region formed during fabrication of the integrated circuit reference voltage source, and the base pinch resistor means is a base diffusion region reduced by an emitter diffusion region both formed during fabrication of the integrated circuit reference voltage source.

5. The reference voltage source of claim 4 wherein the first and second resistor means are base diffusion regions both formed during fabrication of the integrated circuit reference voltage source.

6. The reference voltage source of claim 2 wherein the parallel resistor means is a thin film resistor.

7. The reference voltage source of claim 6 wherein the first and second resistor means are thin film resistors.

8. The reference voltage source of claim 1 wherein the base pinch resistor means is a base diffusion region fabricated concurrently with fabrication of the base of the output control transistor means, reduced by an emitter diffusion region fabricated concurrently with fabrication of the emitter of the output control transistor means.

9. The reference voltage source of claim 8 wherein the base pinch resistor means has a resistance which is affected by fabrication process variations which also affect base-emitter voltage of the output control transistor means.

10. The reference voltage source of claim 1 wherein the coupling means comprises regulator transistor means having an emitter-collector current path connected between the voltage supply terminal means and the output terminal means and having a base connected to the collector of the output control transistor means for regulating current flow between the voltage supply terminal and the output terminal as a function of collector current of the output control transistor means.

11. The reference voltage source of claims 1 or 10 wherein the output control transistor means is a Darlington transistor.

12. The reference source of claim 10 and further comprising:

current supply means for providing a predetermined current to a circuit node formed by the base of the regulator transistor means and the collector of the output control transistor means.

13. The reference voltage source of claim 12 wherein the current supply means comprises:

multiple collector transistor means having an emitter connected to the voltage supply terminal means, a first collector connected to the circuit node, and a second collector and a base; and control means connected to the base and the second collector for controlling current in the first collector.

14. The reference source of claim 13 wherein the control means comprises:

current control transistor means having a collector connected to the base and second collector of the multiple collector transistor means, having a base connected to the bases of the first and second transistor means, and having an emitter; and current limiting resistor means connected to the emitter of the current control transistor means.

15. The reference voltage source of claim 14 and further comprising:

starter circuit means connected to the voltage supply terminal means and the second collector of the multiple collector transistor means for providing an initial current flow through the multiple collector transistor means to initiate operation of the reference voltage source when a supply voltage is initially provided at the voltage supply terminal means.

16. The reference voltage source of claim 1 wherein the coupling means comprises a resistor and the collector of the output control transistor means is connected to the output terminal means.

17. An integrated circuit reference voltage source for providing a reference voltage between first and second terminal means, the reference voltage source comprising:

current source means for providing a controlled current;

base pinch resistor means connected in a current path with the current source means between the first and second terminal means;

a voltage supply terminal means for connection to a supply voltage;

coupling means connected between the voltage supply terminal means and the first terminal means; and output control transistor means having a base, a collector, and an emitter, the base being connected to the current path, and the collector being connected to the coupling means to control the reference voltage between the first and second terminal means as a function of a voltage developed across the base pinch resistor means and a base-emitter voltage of the output control transistor means, wherein the output control transistor means and the base pinch resistor means are concurrently fabricated integrated circuit elements and wherein the base pinch resistor means has a resistance which is affected by semiconductor fabrication process variations which also affect the base-emitter voltage of the output control transistor means.

18. The reference voltage source of claim 17 and further comprising:

parallel resistor means connected in parallel with the base pinch resistor means.

19. The reference voltage source of claim 18 wherein the base pinch resistor means has a resistance which is at least one order of magnitude larger than the resistance of the parallel resistor means.

20. The reference voltage source of claim 18 wherein the parallel resistor means is a base diffusion region formed during fabrication of the integrated circuit reference source, and the base pinch resistor means is a base diffusion region reduced by an emitter diffusion region both formed during fabrication of the integrated circuit reference source.

21. The reference voltage source of claim 17 wherein the base pinch resistor means is a base diffusion region fabricated concurrently with fabrication of the base of the output control transistor means, reduced by an emitter diffusion region fabricated concurrently with fabrication of the emitter of the output control transistor means.

22. The reference voltage source of claim 17 wherein the coupling means comprises regulator means connected between the voltage supply terminal means and the first terminal means and controlled by the output control transistor means to regulate the reference voltage as a function of the voltage developed across the base pinch resistor means and the base-emitter voltage of the output control transistor means.

23. The reference voltage source of claim 22 wherein the coupling means comprises regulator transistor means having an emitter-collector current path connected between the voltage supply terminal means and the first terminal means and having a base connected to the collector of the output control transistor means for regulating current flow between the voltage supply terminal means and the output terminal means as a function of collector current of the output control transistor means.

24. The reference voltage source of claims 17, 22 or 23 wherein the output control transistor means comprises a Darlington transistor.

25. The reference voltage source of claim 23 and further comprising:

current supply means for providing a predetermined current to a circuit node formed by the base of the regulator transistor means and the collector of the output control transistor means.

26. The reference voltage source of claim 25 wherein the current supply means comprises:

multiple collector transistor means having an emitter connected to the voltage supply terminal means, a first collector connected to the circuit node, and a second collector and a base; and control means connected to the base and the second collector of the multiple collector transistor means for controlling current in the first collector.

27. The reference voltage source of claim 26 wherein the control means comprises:

current control transistor means having a collector connected to the base and second collector of the multiple collector transistor means, having a base connected to the current source means, and having an emitter; and current limiting resistor means connected to the emitter of the current control transistor means.

28. The reference voltage source of claim 27 and further comprising:

starter circuit means connected to the voltage supply terminal means and the second collector of the multiple collector transistor means for providing an initial current flow through the multiple collector transistor means to initiate operation of the reference voltage source when a supply voltage is initially provided at the voltage supply terminal means.

29. The reference voltage source of claim 17 wherein the coupling means comprises a resistor and wherein the collector of the output control transistor means is connected to the first terminal means.

* * * * *